US005758248A

United States Patent [19]

Yoshiuchi et al.

[11] Patent Number: 5,758,248

[45] Date of Patent: May 26, 1998

[54] IMAGE FORMING APPARATUS CAPABLE OF AUTOMATICALLY DISCHARGING A CUT-OFF PORTION OF A NEW ROLL SHEET

[75] Inventors: Katsuhiro Yoshiuchi; Hiroshi Kageyama, both of Osaka, Japan

[73] Assignee: Mita Industrial Co., Ltd., Osaka, Japan

[21] Appl. No.: 683,200

[22] Filed: Jul. 18, 1996

[30] Foreign Application Priority Data

Jul. 31, 1995 [JP] Japan ..... 7-195354

[51] Int. Cl.[6] ..... G03G 15/00

[52] U.S. Cl. ..... 399/385; 83/208; 83/209

[58] Field of Search ..... 399/384, 385, 399/387; 271/9.1; 226/28; 83/72, 208–210

[56] References Cited

U.S. PATENT DOCUMENTS 3,591,279 7/1971 Gardner et al. ..... 399/385

4,360,263 11/1982 Miyoshi et al. ..... 399/385

4,739,364 4/1988 Goryohara ..... 399/385

*Primary Examiner*—William J. Royer

*Attorney, Agent, or Firm*—Beveridge, DeGrandi, Weilacher & Young, L.L.P.

[57] ABSTRACT

An image forming apparatus which is adapted to transfer an image on a roll sheet fed out of a roll body and transported through a transportation path to an image forming section. When a user opens a front door of the image forming apparatus and sets a new roll body around a feed reel thereof, the leading edge of a roll sheet fed out of the roll body is located at a predetermined position in the transportation path. When the user closes the front door upon completion of replacement of the roll body, the roll sheet is further fed out, and a leading edge portion of the roll sheet having a predetermined length from the leading edge thereof is cut off. The cut-off portion is discharged through the transportation path out of a main body of the image forming apparatus in the same manner as in an ordinary sheet transportation process.

4 Claims, 9 Drawing Sheets

IMAGE FORMING APPARATUS CAPABLE OF AUTOMATICALLY DISCHARGING A CUT-OFF PORTION OF A NEW ROLL SHEET

CROSS REFERENCE TO RELATED APPLICATION

This application claims priority benefits of Japanese Patent Application No. 7-195354 (1995) under 35 USC §119, the disclosure of said Japanese Patent Application being incorporated herein by reference.

BACKGROUND OF THE INVENTION

1. Field of the Invention

The present invention relates to an image forming apparatus for recording an image on a roll sheet fed out of a roll body.

2. Description of Related Arts

In recent years, there have been provided electrostatic-type image forming apparatuses capable of making a copy of a large-size original such as JIS A0 size. "JIS A0 size", which is one of the sheet sizes specified by Japanese Industrial Standards, is 841 mm×1189 mm (finished dimensions).

Since it is difficult to handle large-size copy sheets such as A0 size one by one, a roll sheet, that is, an elongated continuous copy sheet rolled around a core to form a roll body, is accommodated in a main body of a copying machine.

The roll body is set in the main body of the copying machine by a user with a predetermined length of the roll sheet being fed out of the roll body.

The leading edge of the fed-out roll sheet has to be aligned with a line perpendicular to the direction of transportation of the roll sheet. However, the leading edge of the roll sheet tends to be diagonal with respect to the line perpendicular to the transportation direction.

A conventional approach to this problem is to employ a leading-edge cutting mode in which a roll sheet is fed out from a roll body set in position and a leading edge portion thereof having a predetermined length from the leading edge thereof is cut off by means of a cutter mechanism so that a new leading edge thereof is aligned with the line perpendicular to the transportation direction.

However, the leading edge portion which has been cut off from the roll sheet remains in a transportation path of the copying machine and, therefore, a user has to remove the cut-off sheet in the same manner as in a jam recovery process. This is a troublesome operation for the user.

In addition, if the user forgets to remove the cut-off sheet, the cut-off sheet causes a jam.

SUMMARY OF THE INVENTION

It is therefore an object of the present invention to provide an image forming apparatus which is capable of automatically removing a portion of a roll sheet cut off in a leading-edge cutting mode at a roll sheet replacement without user help, thereby offering an improved operability.

In accordance with one feature of the present invention to achieve the aforesaid object, there is provided an image forming apparatus including: a transportation path for guiding a roll sheet fed out of a roll body through an image forming section to discharge a cut-off portion of the roll sheet out of a main body of the image forming apparatus; transportation means for transporting the roll sheet along the transportation path; cutter means disposed in the transportation path for cutting the roll sheet; control means for controlling the operations of the transportation means and the cutter means; and signal outputting means for outputting a signal indicative of completion of replacement of the roll body; wherein the control means, in response to the signal inputted from the signal outputting means, controls the operations of the transportation means and the cutter means so as to feed the roll sheet out of the roll body, then cut off a leading edge portion of the fed-out roll sheet having a predetermined length from the leading edge of the roll sheet and guide the cut-off portion along the transportation path to discharge the cut-off portion out of the main body.

With this arrangement, the cut-off portion of the roll sheet can automatically be discharged through the transportation path out of the main body and, therefore, a user does not have to perform an operation for removing the cut-off sheet. As a result, the operability of the image forming apparatus can be improved. Conventionally, a jam occurs if the user performs the next image formation without removing the cut-off sheet. This arrangement can avoid such an accident.

The transportation means include a plurality of downstream transportation means each disposed downstream of the cutter means, and the cut-off sheet preferably has a length equivalent to or greater than the greatest one of distances between respective adjacent pairs of downstream transportation means.

Thus, the sheet cut off by the cutter means can be transported along the transportation path downstream of the cutter means, and discharged out of the main body of the image forming apparatus. Particularly, if the length of the cut-off sheet is equivalent to the greatest one of the distances between the respective adjacent pairs of downstream transportation means, the length of the cut-off sheet to be discarded can be minimized with minimum wastage.

DETAILED DESCRIPTION OF THE PREFERRED EMBODIMENT

An embodiment of the present invention will hereinafter be described in detail with reference to the attached drawings.

A copying machine herein described is adapted to form a copy image of a large-size original such as A0 size. In the copying machine, an original being transported is illuminated to be scanned by a stationary optical system, and an image is formed on the basis of the scanning.

Figure 1:
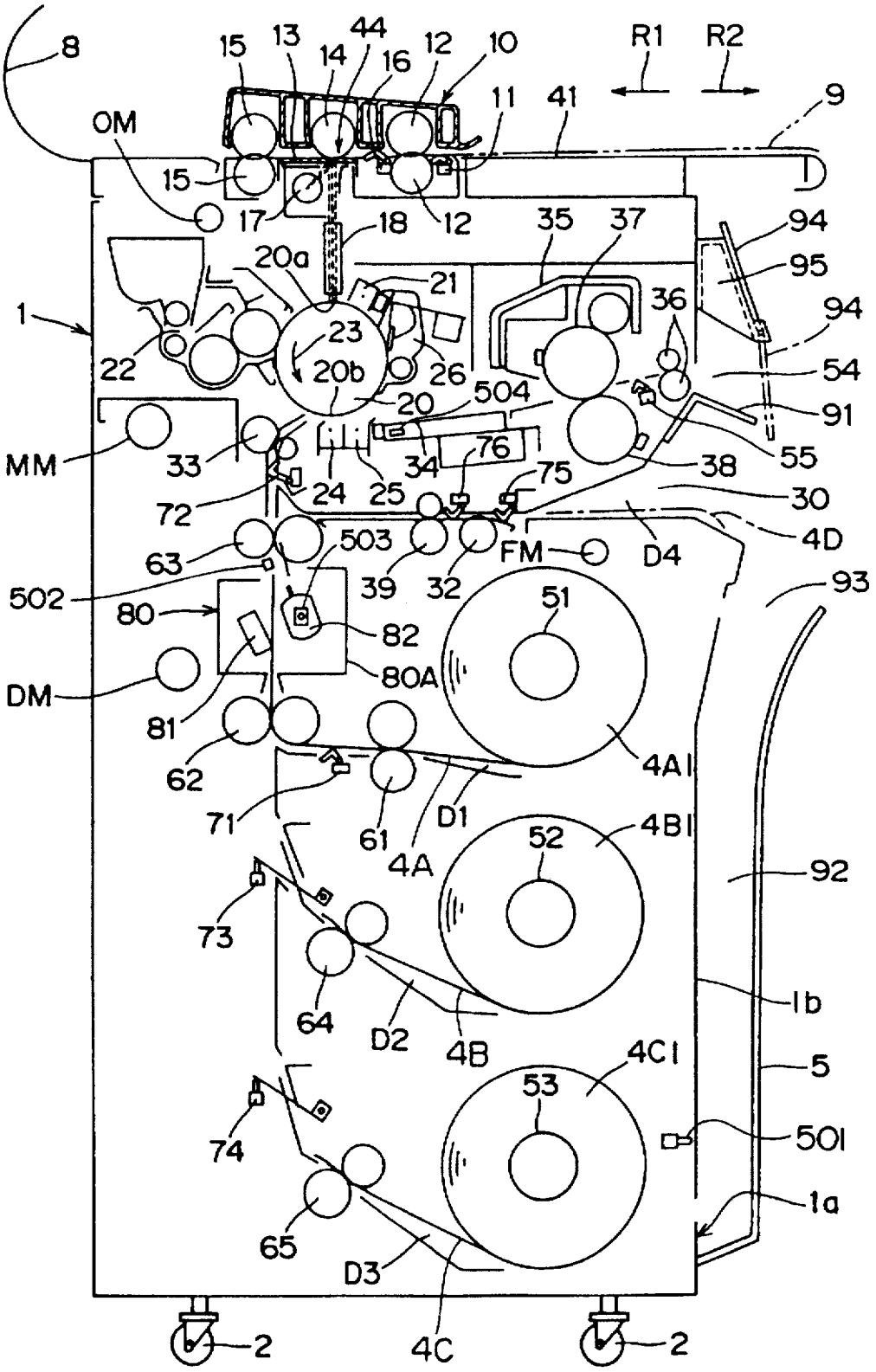
FIG. 1 is a schematic sectional view illustrating the internal construction of a copying machine according to one embodiment of the present invention.
Figure 2:
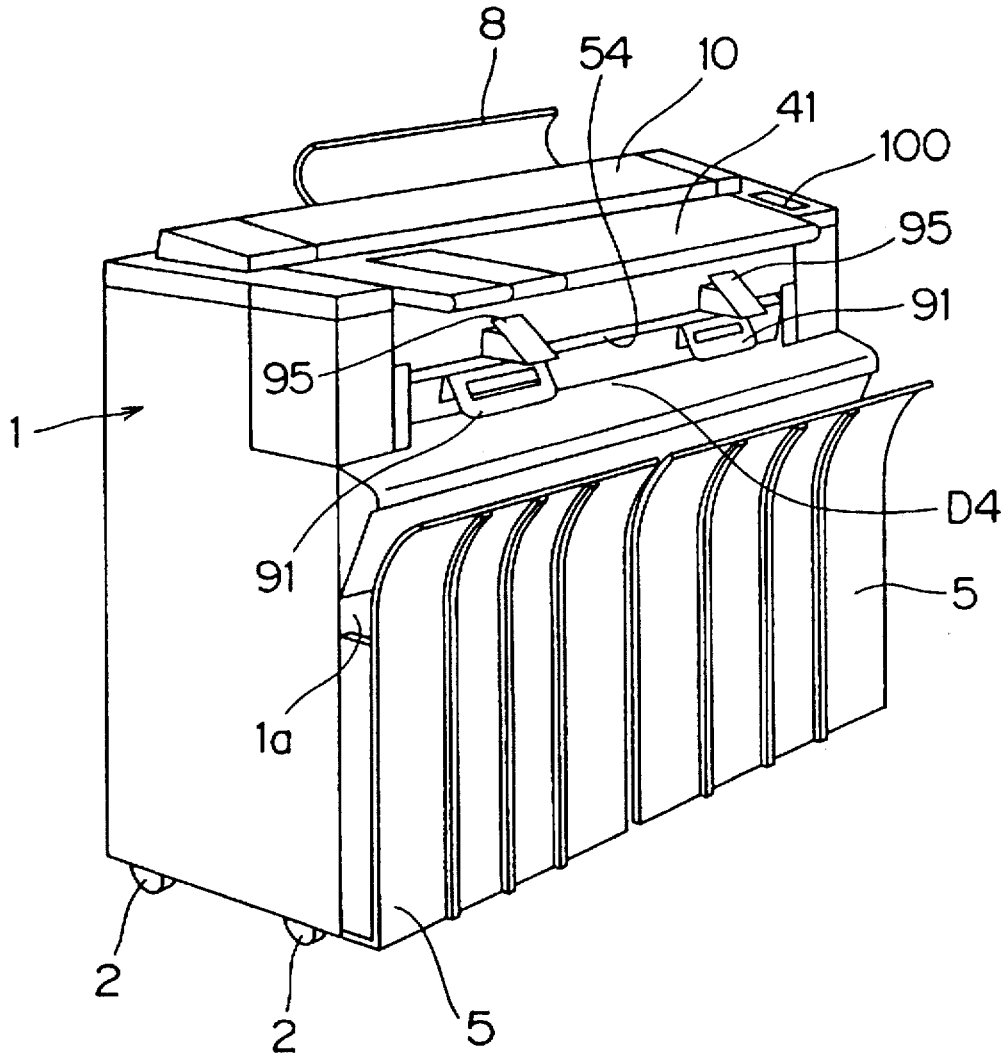
FIG. 2 is a perspective view illustrating the external construction of the copying machine.
Figure 3:
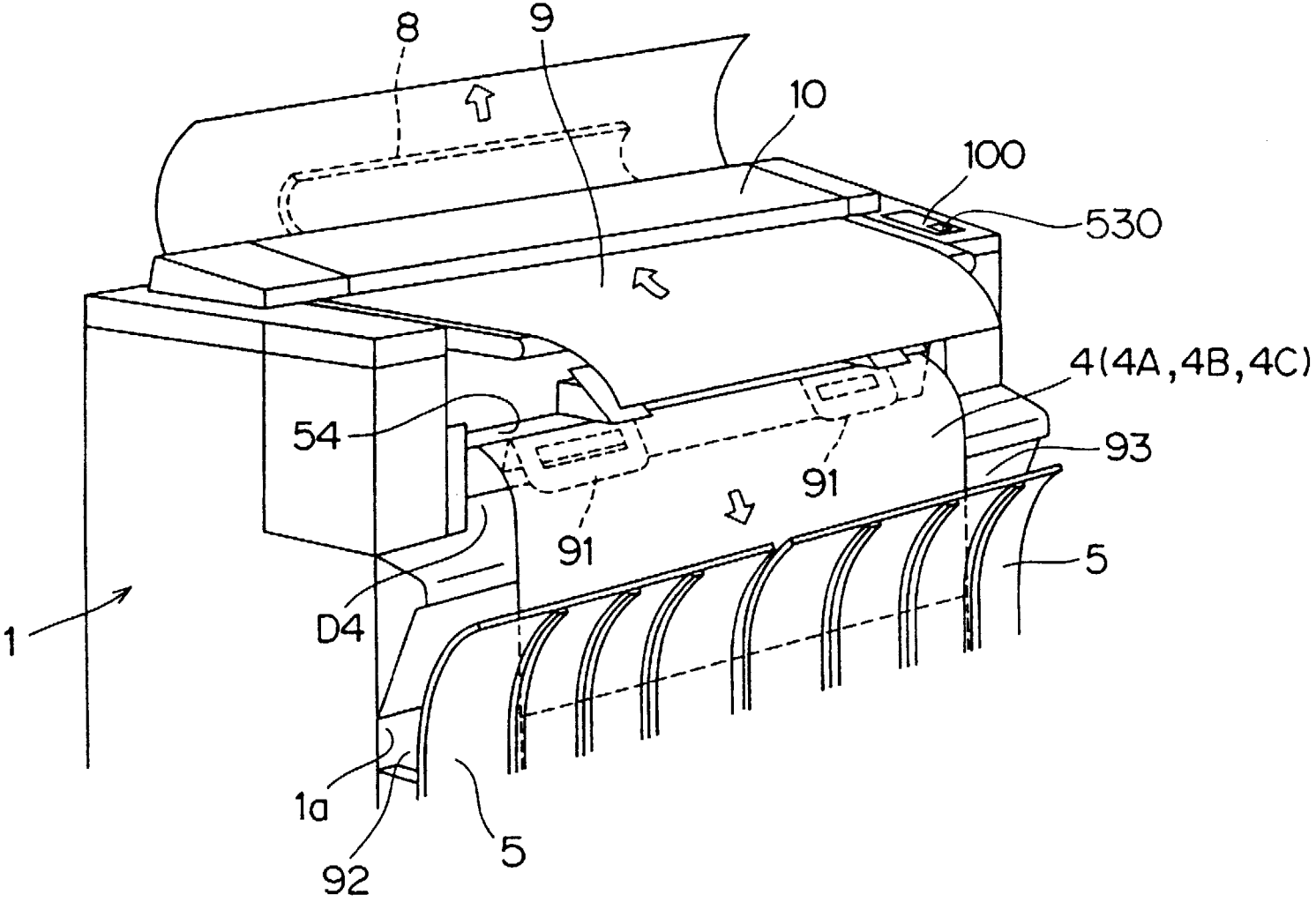
FIG. 3 is a perspective view illustrating the copying machine in operation.

Referring to FIG. 1, a main body 1 of the copying machine has caster wheels 2 to the underside thereof for free movement. Referring to FIGS. 1 to 3, an original transportation section 10 for transporting an original 9 along an original transportation path 41 on the top face of the main body 1 is provided on the machine body. A discharge port 54 for discharging a sheet having a toner image transferred thereon opens in a front face la of the main body 1. The sheet discharged from the discharge port 54 is guided by a guide member 91, dropped through a guide opening 93 with the leading edge thereof oriented downward, and accommodated in a pocket 92 defined by a front cover 5 provided along the front face 1*a* of the main body 1, as shown in FIG. 3. On a side edge portion of the top face of the main body 1 is provided an operation section 100 having switches, keys and the like for making various settings related to a copying operation.

Referring to FIG. 1, three roll sheets 4A, 4B and 4C wound around cores into roll bodies 4A1, 4B1 and 4C1 are located in upper, middle and lower positions, respectively, within a region between a vertically middle portion and a lower portion of the main body 1. The roll bodies 4A1, 4B1 and 4C1 are rotatably supported by feed reels 51, 52 and 53, respectively, for co-rotation therewith. The feed reels 51, 52 and 53 are driven by a sheet feeding motor DM (which will be described later) to feed and rewind the roll sheets 4A, 4B and 4C. Examples of sheets to be used as the roll sheets 4A, 4B and 4C include normal paper, film and tracing paper.

In the central portion of the main body 1 is disposed a bypass sheet feeding path D4 for feeding a cut-sheet preliminarily cut into a predetermined size such as A0 size to A4 size through a manual sheet-feeding section 30 provided on the front face 1*a* of the main body 1. Referring to FIG. 1, at least part of the front face 1*a* of the main body 1 is formed into a front door 1*b* which is openable for replacement of the roll sheets 4A, 4B and 4C, and a front door open/close sensor 501 for detecting the open/close state of the front door 1*b* is provided inside the main body 1. In FIG. 1, the front cover 5 defining the pocket 92 is not shown.

The roll sheet 4A in the upper position is transported along a first sheet feeding path D1 to a photoreceptor drum 20 through the feed reel 51, sheet feeding rollers 61, a first leading-edge detection switch 71 for detecting the leading edge of the transported roll sheet 4A, transportation rollers 62, a cutter mechanism 80, registration rollers 63, a second leading-edge detection switch 72 for detecting the leading edge of the transported sheet 4A, 4B, 4C or 4D, and transportation rollers 33 in this order.

The roll sheet 4B in the middle position is transported along a second sheet feeding path D2 to the photoreceptor drum 20 through the feed reel 52, sheet feeding rollers 64, a third leading-edge detection switch 73 for detecting the leading edge of the transported roll sheet 4B, the transportation rollers 62, the cutter mechanism 80, the registration rollers 63, the second leading-edge detection switch 72, and the transportation rollers 33. The path downstream of the transportation rollers 62 is common to the first sheet feeding path D1 in this order.

The roll sheet 4C in the lower position is transported along a third sheet feeding path D3 to the photoreceptor drum 20 through the feed reel 53, sheet feeding rollers 65, a fourth leading-edge detection switch 74 for detecting the leading edge of the transported roll sheet 4C, the transportation rollers 62, the cutter mechanism 80, the registration rollers 63, the second leading-edge detection switch 72, and the transportation rollers 33 in this order. The path downstream of the transportation rollers 62 is common to the first transportation path D1.

The bypass sheet feeding path D4 is a path which leads the cut-sheet 4D introduced from the manual sheet-feeding section 30 to the photoreceptor drum 20 through a fifth leading-edge detection switch 75 for detecting the leading edge of the transported cut-sheet 4D, a separation roller 32 for separating cut-sheets one from another by an abut plate (not shown) abutted against the cut-sheets, a sixth leading-edge detection switch 76 for detecting the leading edge of the transported cut-sheet 4D, registration rollers 39, the second leading-edge detection switch 72, and the transportation rollers 33 in this order. The path downstream of the second leading-edge detection switch 72 in the bypass sheet feeding path D4 is common to the first transportation path D1.

The first, second and third sheet feeding paths D1, D2 and D3 and a transportation path 34 to be described later constitute the transportation path for transporting the roll sheet 4A, 4B or 4C in accordance with the present invention. The feed reels 51 to 53, the transportation or sheet feeding rollers 61, 62, 64 and 65, the registration rollers 63, transportation rollers 33, a heat roller 37 and a press roller 38 for fixation, and discharge rollers 36 constitute the transportation means in accordance with the present invention.

The cutter mechanism 80 has an elongated stationary blade 81 provided in a casing 80A and extending in a direction perpendicular to the direction of transportation of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80. The rotary blade 82 stands by at a home position in a rotation path as shown in FIG. 1. The rotary blade 82, as required, is rotated to cut the roll sheet 4A, 4B or 4C, and then returns to the home position. A home position detecting switch 503 for detecting the home position of the rotary blade 82 is provided on the rotary blade 82.

The original transportation section 10 is adapted to switch the transportation direction between a regular direction R1 and a reverse direction R2 for the transportation of the original 9. The image forming operation is performed when the original is transported in the regular direction R1. When a plurality of copies are made from one original, the original transportation section 10 alternates the regular transportation direction R1 and the reverse transportation direction R2 to transport the original 9. The original transportation path 41 is provided upstream from the original transportation section 10 with respect to the regular direction R1 on the top face of the main body 1 and laterally projects from the top face of the main body 1.

The original transportation section 10 has a first original edge detection switch 11, first transportation rollers 12, a second original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the original 9 when the first original edge detection switch 11 is switched on. The second transportation roller 14 is positioned opposite to a transparent plate 13 for exposing the original 9 to slit exposure, and serves to press the original 9 against the transparent plate 13. The third transportation rollers 15 serve to discharge the original 9 after the light exposure.

The second original edge detection switch 16 is switched on when the original 9 is transported therethrough in the regular transportation direction R1, thereby detecting the leading edge (with respect to the regular transportation direction R1) of the original 9. In response to the switch-on of the second original edge detection switch 16, the transportation of the roll sheet 4A, 4B or 4C (hereinafter referred to simply as "roll sheet 4" when the term is used to explain the transportation of the roll sheet for an image transfer operation) is started, thereby coordinating the transportation of the roll sheet 4 with the transportation of original 9.

The first original edge detection switch 11 is switched off after the original 9 is transported therethrough in the regular transportation direction R1, thereby detecting the tail edge (with respect to the regular transportation direction R1) of the original 9. The cutter mechanism 80 is driven in a predetermined timing after a lapse of a predetermined time period from the time point of the detection of the tail edge of the original 9 to cut the roll sheet 4. In this embodiment, the length of the sheet feeding path extending from the cutter mechanism 80 to an image transfer position **20*b* of a corona discharger for image transfer 24 is set longer than the length of the original transportation path extending from the first original edge detection switch 11 to an original light-exposure position 44 by a distance between a light exposure position 20*a* of the photoreceptor drum 20 and the image transfer position 20*b*. Thus, the tail edge of the sheet 4 cut in the predetermined timing corresponds to the tail edge of the original 9** for image formation.

The second original edge detection switch 16 is switched off after the original 9 is transported therethrough in the reverse transportation direction R2, thereby detecting the tail edge (with respect to the reverse transportation direction R2) of the original 9. In response to the switch-off of the second original edge detection switch 16, the driving of the transportation rollers 12, 14 and 15 is stopped. At this time, the leading edge of the original 9 is held between the transportation rollers 12 for the next copying operation. A reference numeral 8 denotes a reversion member for preventing the original 9 from dropping to the rear side of the main body 1 by reversing the transportation direction of the original.

A stationary light source 17 for irradiating the document surface of the original 9 for the scanning thereof is disposed in association with the transparent plate 13. The light from the light source 17 is emitted onto the surface of the original 9 through the transparent plate 13. Light reflected on the surface of the original 9 is led to the surface of the photoreceptor drum 20 disposed in a generally central portion of the main body 1 by means of a selfoc lens 18. Before being exposed to the light from the selfoc lens 18, the surface of the photoreceptor drum 20 is uniformly charged by a corona discharger 21 for electrostatic charging. After the light exposure, an electrostatic latent image corresponding to a original image is formed on the surface of the photoreceptor drum 20. The electrostatic latent image is developed into a toner image by a developing unit 22. The toner image formed on the photoreceptor drum 20 is brought into the vicinity of a corona discharger 24 for image transfer, as the photoreceptor drum 20 is rotated in a direction indicated by an arrow 23.

On the other hand, the roll sheet 4 led to the photoreceptor drum 20 from the sheet feeding path D1, D2 or D3 is brought into the vicinity of the corona discharger 24 for image transfer, and then the toner image formed on the surface of the photoreceptor drum 20 is transferred onto the roll sheet 4 by way of corona discharge by the corona discharger 24. The roll sheet 4 having the toner image transferred thereon is removed from the surface of the photoreceptor drum 20 by way of corona discharge by a corona discharger 25 for sheet removal, and then led to a fixing unit 35 through the transportation path 34. In the fixing unit 35, toner is fixed onto the surface of the roll sheet 4 by heat-pressing the roll sheet 4 between the heat roller 37 and the press roller 38. The roll sheet 4 on which the toner is fixed is discharged out of the main body 1 through a discharge detection switch 55 and the discharge rollers 36, guided by the guide member 91, and accommodated in the pocket 92, as described above. After the toner image is transferred, the toner remaining on the surface of the photoreceptor drum 20 is removed by a cleaning unit 26 for the next electrostatic latent image formation. Similarly, the cut-sheet 4D led to the photoreceptor drum 20 through the bypass sheet feeding path D4 is subjected to the toner image transfer and the toner fixation, and then discharged into the pocket 92.

An auxiliary guide plate 94 is disposed above the guide member 91. The auxiliary guide plate 94 is pivotally supported by a stay 95 attached to the front face **1*a* of the main body 1. The auxiliary guide plate 94 assumes either a guiding attitude (indicated by a dashed line in FIG. 1) for guiding the discharged roll sheet 4 hanging down forwardly of the guide member 91 into the pocket 92 cooperatively with the guide member 91 or an accommodation attitude (indicated by a solid line in FIG. 1) for sheet accommodation in which the auxiliary guide plate 94 is supported by the stay 95. The attitude of the auxiliary guide plate 94** can be shifted by the pivotal movement thereof.

The photoreceptor drum 20, the developing unit 22 and the corona discharger 24 for image transfer and the like constitute the image forming section in accordance with the present invention. In this embodiment, the copying machine further includes a main motor MM for driving the image forming section, a sheet feeding motor DM for driving the transportation rollers for feeding the sheets 4A, 4B, 4C and 4D, a fixation motor FM serving as a driving means for driving the heat roller 37 and press roller 38 of the fixing unit 35, and an original feeding motor OM for driving the original transportation section 10.

Figure 5:
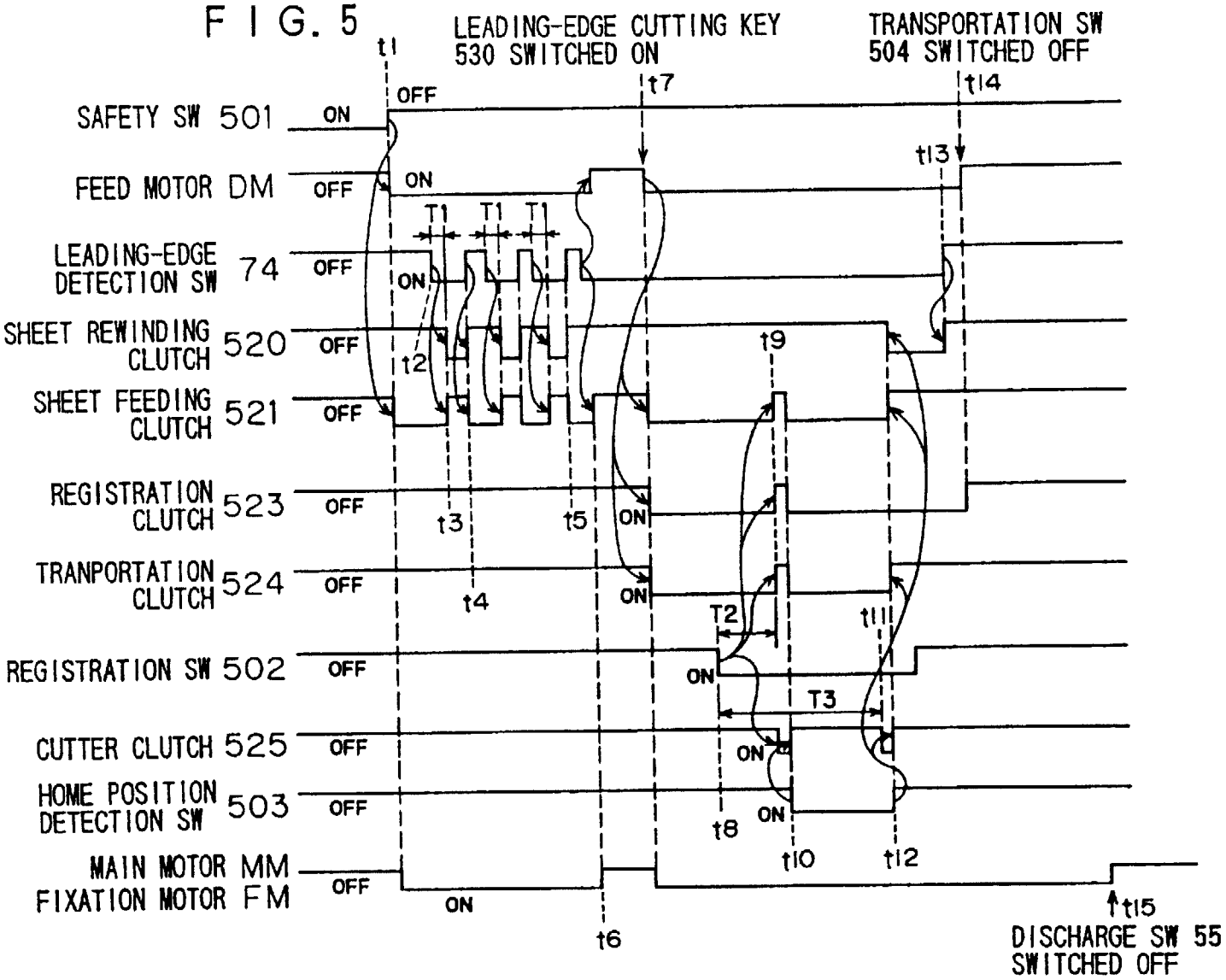
FIG. 5 is a timing chart illustrating successive operations for the attitude correction of a roll sheet and the cutting of a leading edge portion of the roll sheet which are to be performed when the roll body is replaced.
Figure 5:
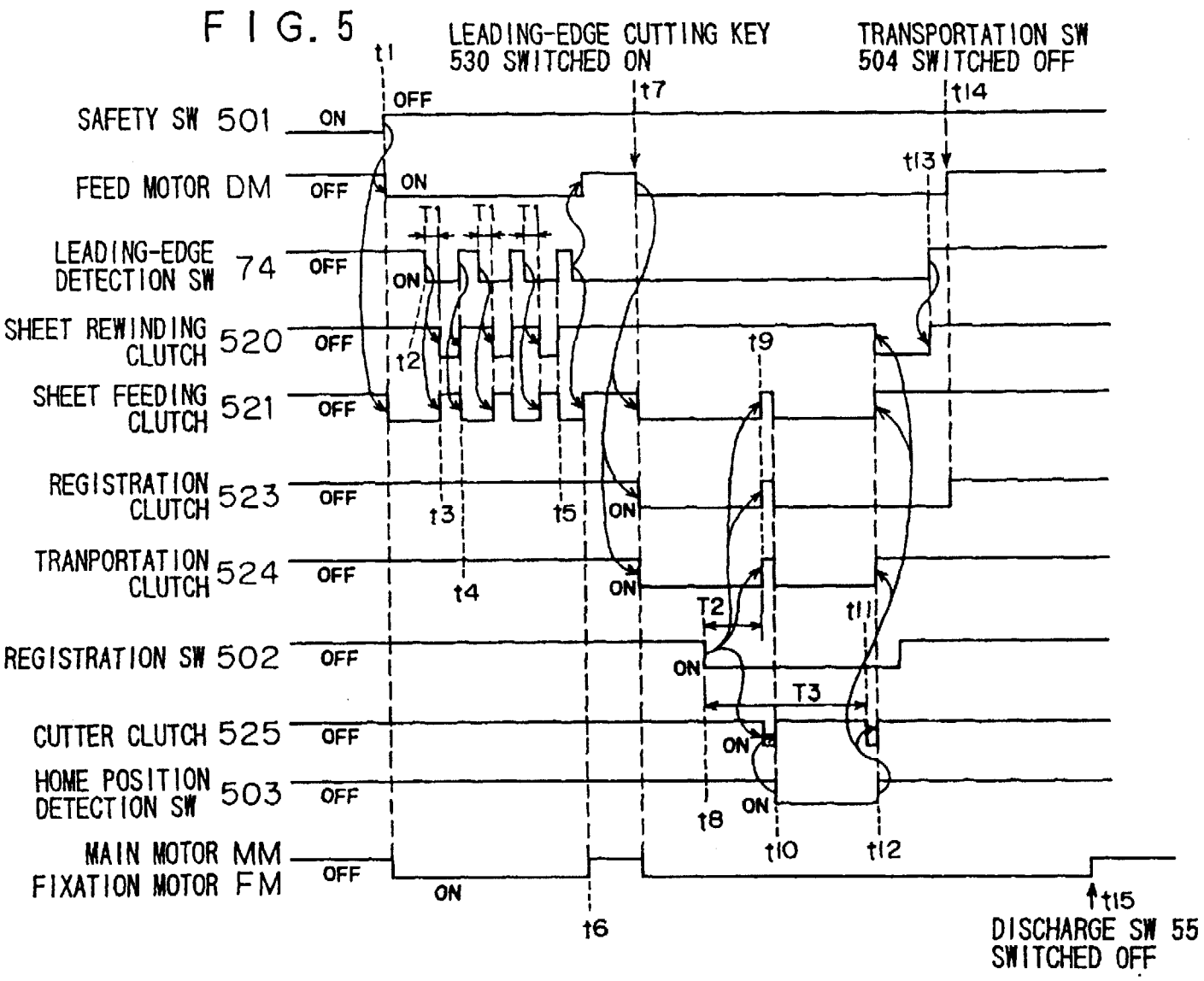
Figure 4:
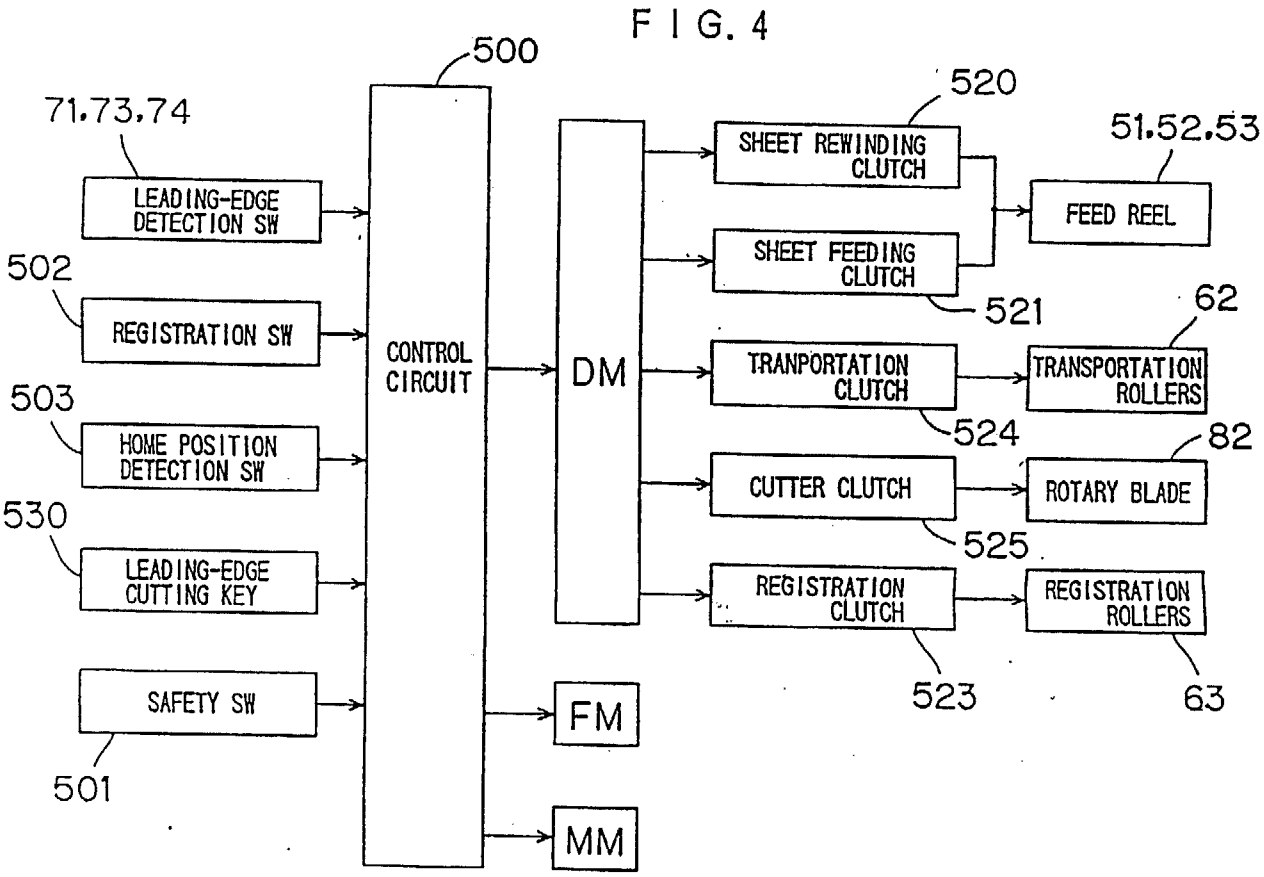
FIG. 4 is a block diagram illustrating the electrical construction of the copying machine.
Figure 5:
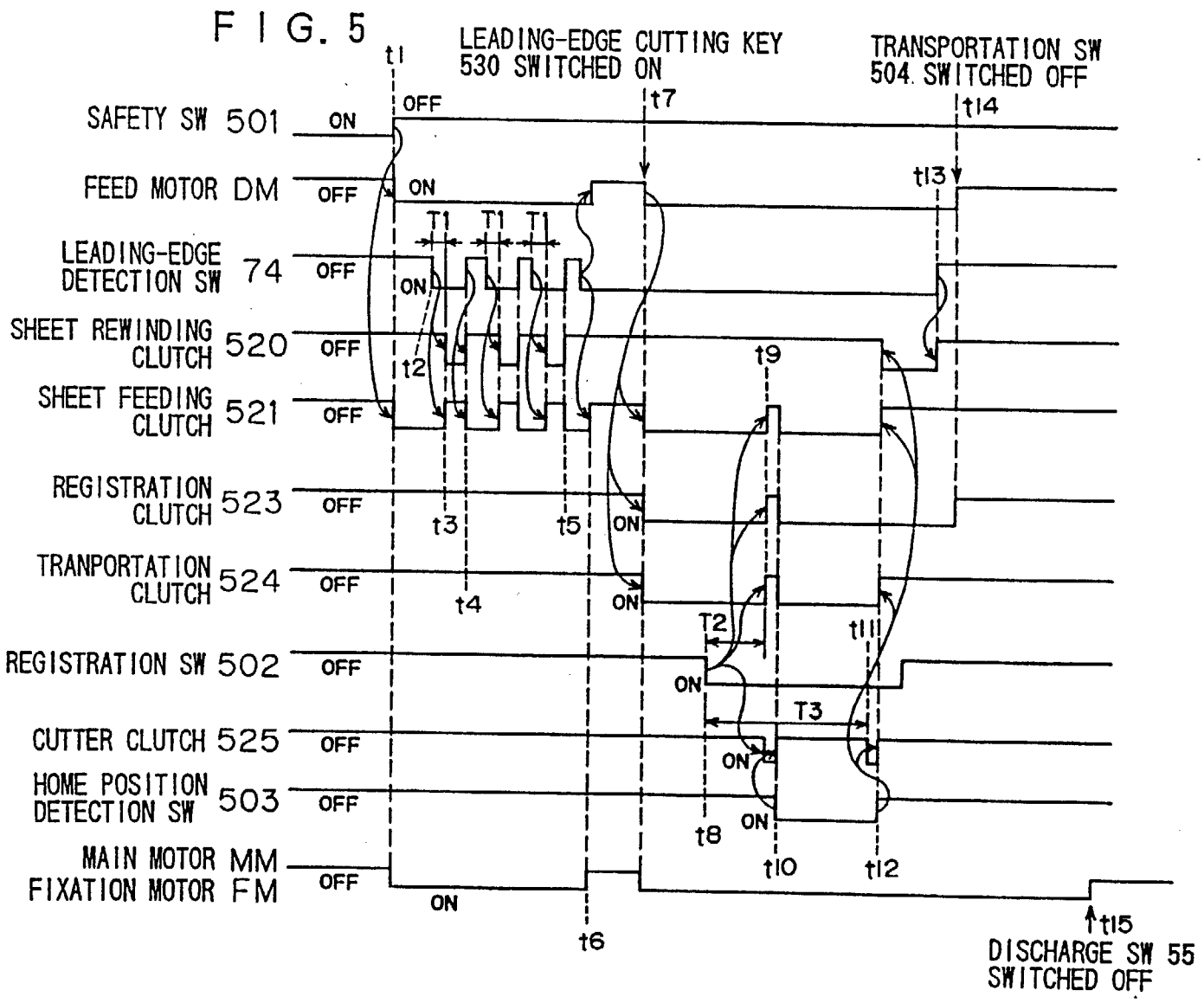
Figure 6:
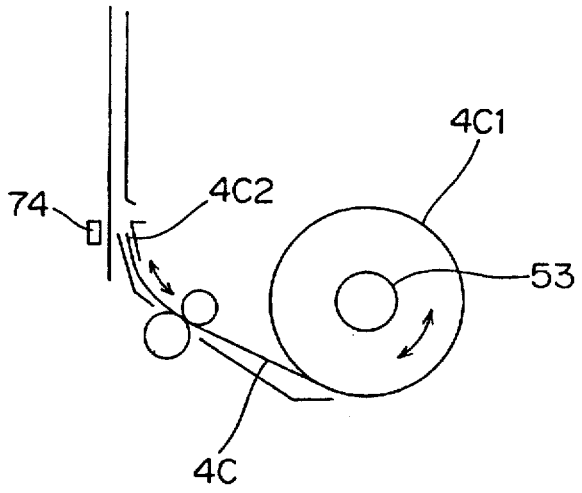
Figure 7:
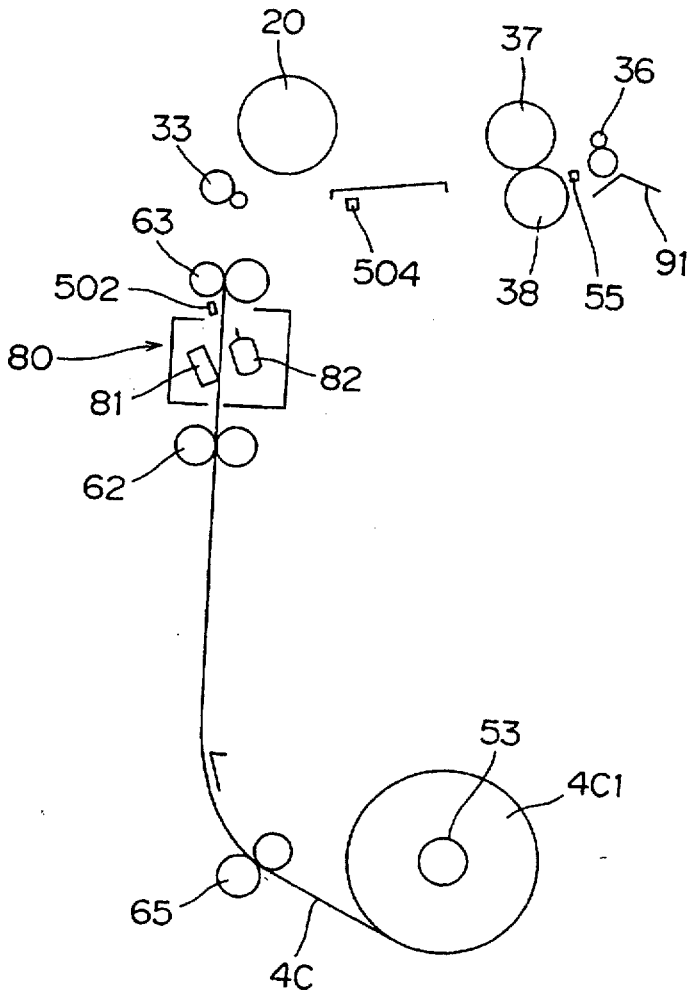
Figure 8:
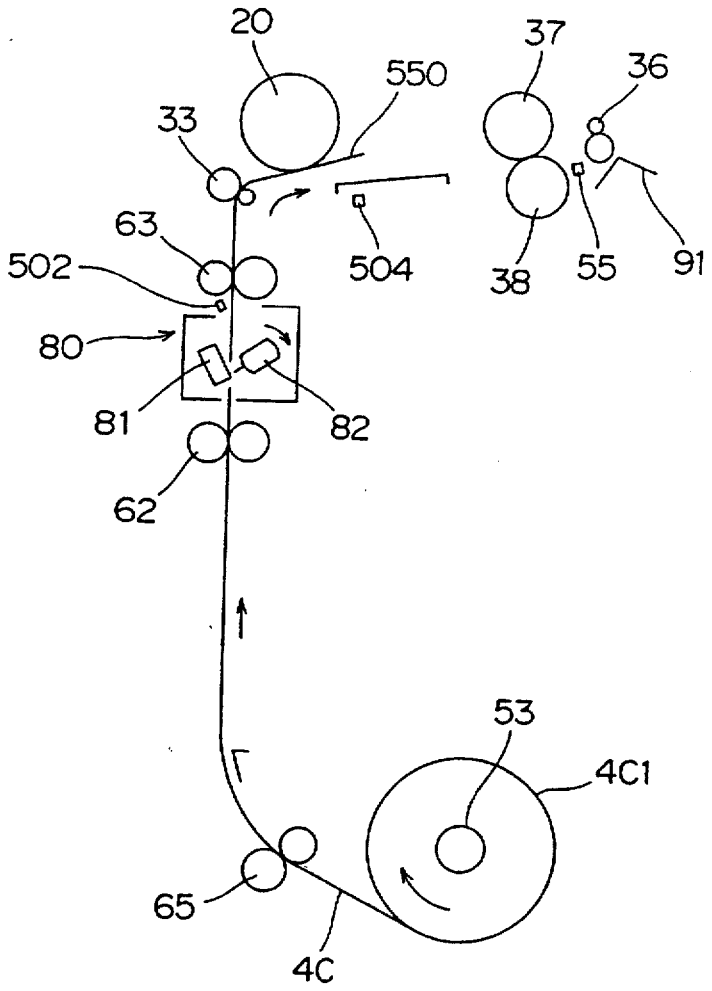
Figure 9:
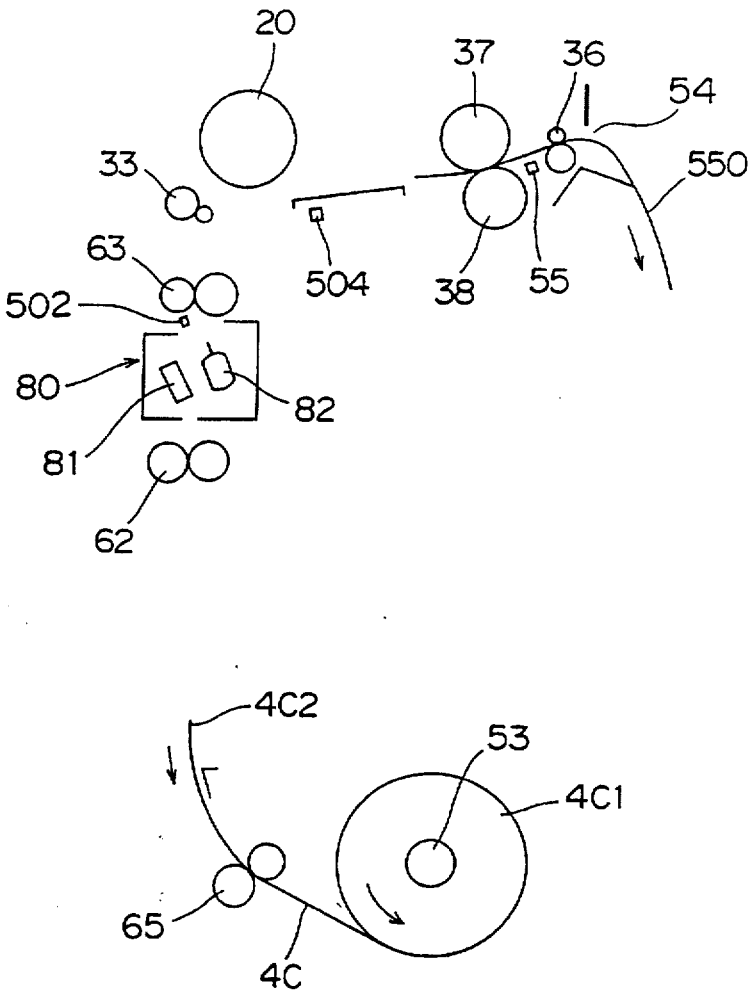

FIG. 4 is a block diagram illustrating the construction of a control circuit which is a feature of the present invention. FIG. 5 is an operation timing chart of the control circuit.

Referring to FIGS. 1 and 4, one feature of the copying machine is that, when the roll body 4A1, 4B1 or 4C1 is replaced, successive operations of feeding and rewinding the roll sheet 4 are repeated a plurality of times to correct a skew state of the leading edge of the roll sheet so that the leading edge is aligned with a line perpendicular to the direction of the transportation of the sheet roll.

Referring to FIG. 4, more specifically, a control circuit 500 is provided for controlling the main motor MM, the sheet feeding motor DM and the fixation motor FM. The control circuit 500 may be a circuit dedicated for this purpose, or may be constructed as part of a control circuit (e.g., CPU) for controlling the comprehensive operation of the copying machine.

The control circuit 500 receives an ON signal inputted from a safety switch or front door open/close sensor 501 when the front door **1*b* is open, signals inputted from the leading-edge detection switches 71, 73 and 74 for the roll sheets 4A, 4B and 4C, a signal inputted from a registration switch 502, a signal inputted from a home position detecting switch 503 for detecting the home position of the rotary blade 82 of the cutter mechanism 80, and a signal inputted from a transportation switch 504. Based on these signals, the control circuit 500 performs the following operations: (1) controlling the rotations of the main motor MM, the sheet feeding motor DM and the fixation motor FM; (2) controlling a sheet rewinding clutch 520 and a sheet feeding clutch 521 to control a sheet-rewinding/sheet-feeding operation of the feed reels 51, 52 and 53; (3) controlling a registration clutch 523 to control a driving/stopping operation of the registration rollers 63; (4) controlling a transportation clutch 524 to control a driving/stopping operation of the transportation rollers 62; and (5) controlling a cutter clutch 525 to control a cutting/stopping operation of the rotary blade 82**.

With reference to the timing chart shown in FIG. 5, there will next be described operations of the sheet feeding motor DM, the feed reel 53, the registration rollers 63, the transportation rollers 62 and the rotary blade 82 which are controlled by the control circuit 500. In the following explanation, it is assumed that the roll sheet 4C in the lower position is replaced.

When the front door **1*b* is closed upon completion of the setting of the roll body 4C1, the safety switch 501 is switched off by the front door 1*b* at a time point t1**.

In response to the switch-off of the safety switch 501, the control circuit 500 rotates the main motor MM, the fixation motor FM and the sheet feeding motor DM, and switches on the sheet feeding clutch 521 to rotate the feed reel 53 in a sheet feeding direction. During the sheet feeding operation, the leading edge 4C2 of the roll sheet 4C is detected by the fourth leading-edge detection switch 74 at a time point t2. The sheet feeding clutch 521 is switched off and the sheet rewinding clutch 520 is switched on at a time point t3 after a lapse of a predetermined time period T1 (e.g., 0.4 seconds) from the time point t2 to rewind the roll sheet 4C around the roll body 4C1 by a predetermined length.

During the sheet rewinding operation, the leading edge 4C2 of the roll sheet 4C passes the fourth leading-edge detection switch 74 at a time point t4. At this time, the sheet rewinding clutch 520 is switched off and the sheet feeding clutch 521 is switched on to start the sheet feeding operation again. That is, the leading edge 4C2 of the roll sheet 4C is stopped at a position which is located a little upstream of the fourth leading-edge detection switch 74, and then the sheet feeding operation is restarted.

Figure 6:
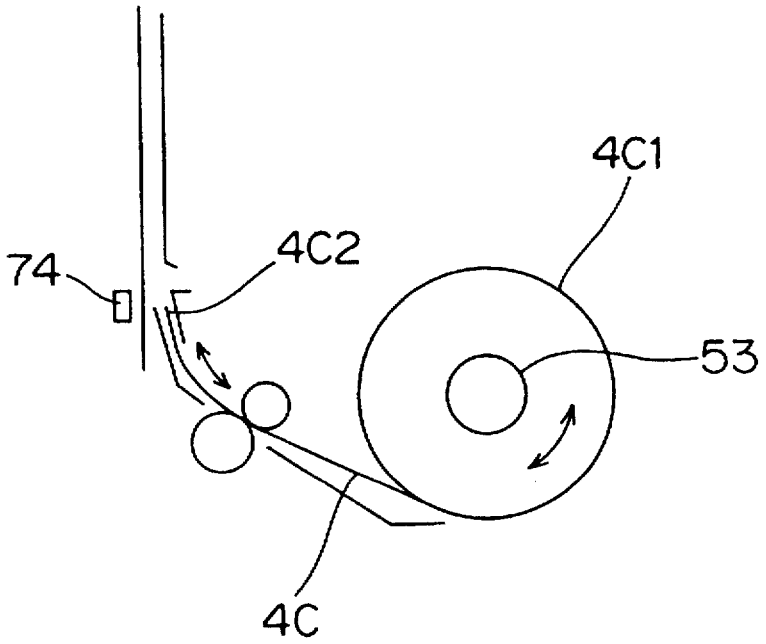
FIG. 6 is a schematic side view of the major portion of a sheet feeding mechanism of the copying machine for explaining the attitude correction of the roll sheet.

After successive operations of feeding and rewinding the roll sheet are repeated a plurality of times (three times in this embodiment) in the aforesaid manner as shown in FIG. 6, the sheet roll is fed again. Then, the main motor MM, the fixation motor FM and the sheet feeding motor DM are stopped, and the sheet feeding clutch 521 is switched off at a time point t6 after a lapse of 0.4 second from the time point t5 when the leading edge 4C2 of the roll sheet 4C is detected by the fourth leading-edge detection switch 74. Thus, the sheet feeding operation is stopped in such a state where the leading edge 4C2 of the roll sheet 4C projects by a predetermined length (e.g., 30 mm) from the fourth leading-edge detection switch 74 in the transportation direction.

Since the feeding and rewinding of the roll sheet 4C is repeated a plurality of times when the front door **1*b* is closed upon completion of the replacement of the roll body 4C1, the skew state of the leading edge 4C2 of the roll sheet 4C can automatically and assuredly be corrected so that the leading edge 4C2 is aligned with the line perpendicular to the transportation direction. Thus, a jam can assuredly be prevented which may be caused due to diagonal transportation of the roll sheet 4C**.

When a user presses a leading-edge cutting key 530 in the operation section 100 at a time point t7, the main motor MM, the fixation motor FM and the sheet feeding motor DM are rotated, and the sheet feeding clutch 521, the registration clutch 523 and the transportation clutch 524 are switched on. In response thereto, the feed reel 53, the registration rollers 63 and the transportation rollers 62 are driven for rotation thereof to transport the roll sheet **4*c* fed out of the roll body 4C1 toward the cutter mechanism 80**.

Figure 7:
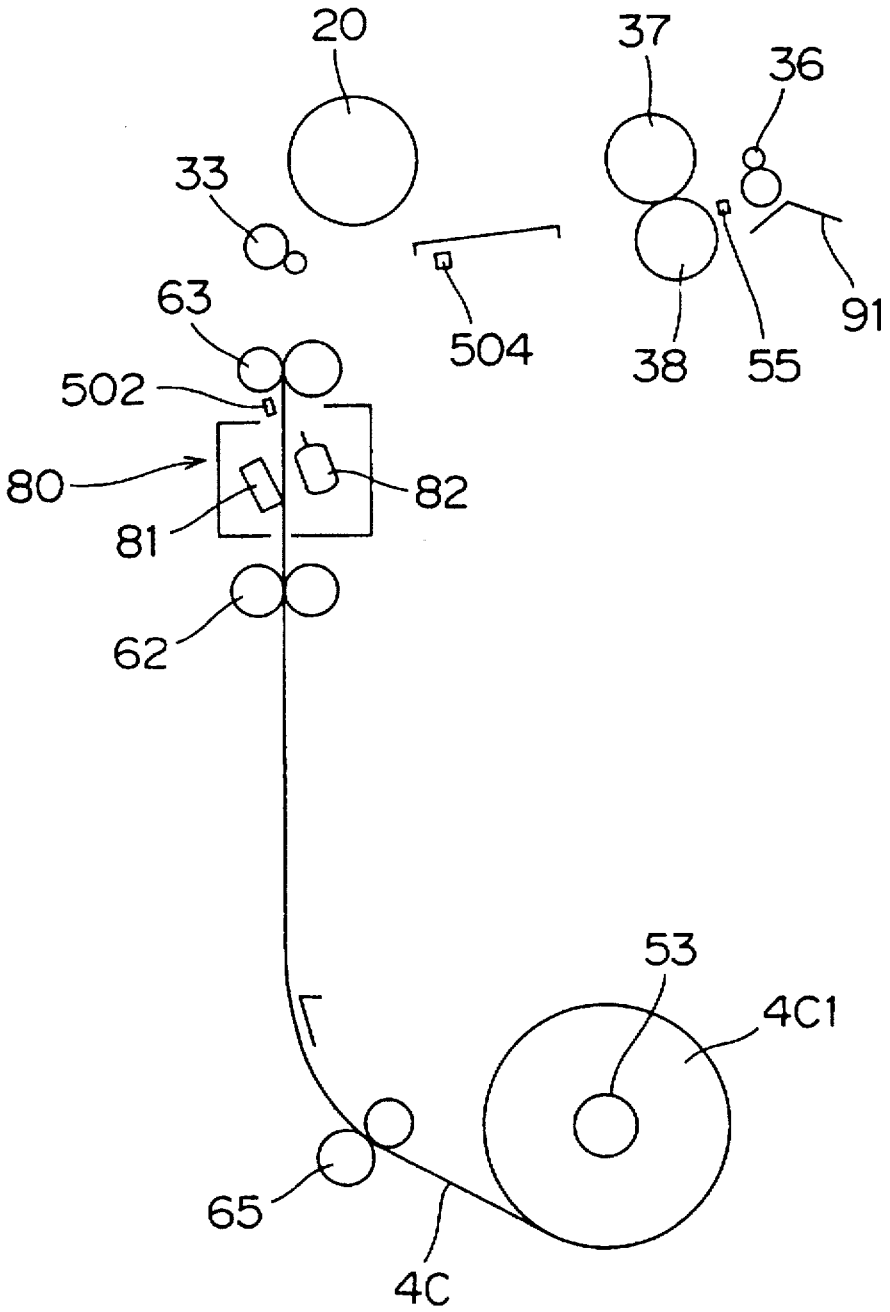
FIG. 7 is a schematic diagram of the transportation path illustrating a state where the leading edge of the roll sheet is stopped by registration rollers in a sheet cutting operation.

The leading edge 4C2 of the transported roll sheet 4C passes the registration switch 502 at a time point t8. The sheet feeding clutch 521, the registration clutch 523 and the transportation clutch 524 are switched off at a time point t9 after a lapse of a predetermined time period T2 (e.g., 0.38 second) from the time point t8 to stop the rotation of the feed reel 53, the registration rollers 63 and the transportation rollers 62. Thus, the roll sheet 4C stands by with the leading edge 4C2 thereof abutting against the registration rollers 63 (see FIG. 7).

The cutter clutch 525 is switched on at the time point t9 after a lapse of the predetermined time period T2 (0.38 second) from the time point t8 to rotate the rotary blade 82. When the home position detecting switch 503 detects the home position at a time point t10, the cutter clutch 525 is switched off so that the rotary blade 82 stands by at the home position.

Figure 8:
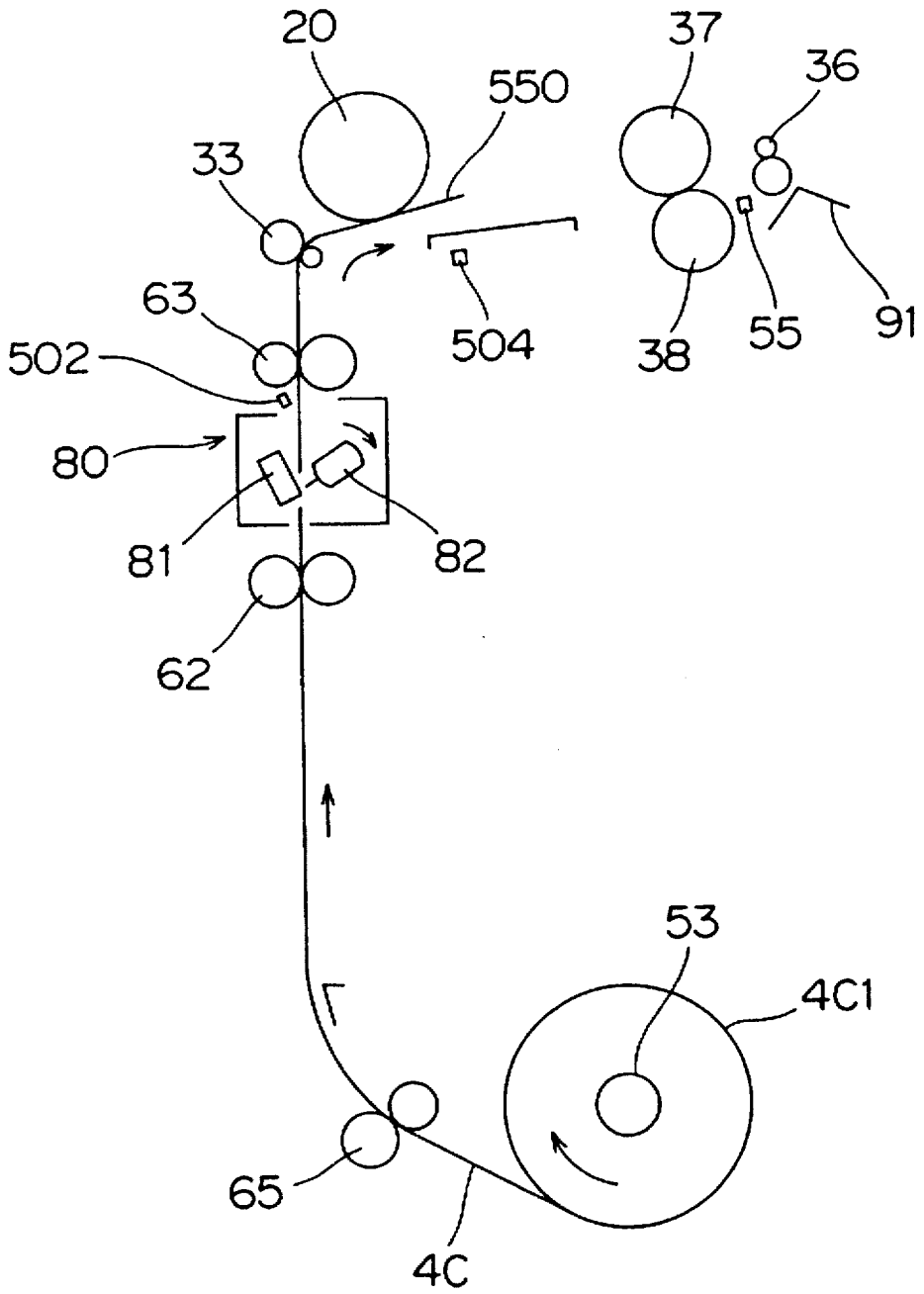
FIG. 8 is a schematic diagram of the transportation path illustrating a state where the roll sheet is cut in the sheet cutting operation.

In response to the detection of the home position, the sheet feeding clutch 521, the registration clutch 523 and the transportation clutch 524 are switched on to restart the transportation of the roll sheet 4C. During the transportation, the cutter clutch 525 is switched on at a time point t11 after a lapse of a predetermined time period T3 from the time point t8 when the registration switch 502 is switched on. Thus, the rotary blade 82 is rotated to cut the roll sheet 4C (see FIG. 8).

The time period T3 is determined in the following manner. In this embodiment, a cut-off portion of the roll sheet is to be discharged from the copying machine through the transportation path 34 in the same manner as in an ordinary copying operation. To achieve this, the length of the cut-off sheet should be greater than a distance between the transportation rollers 33 and the heat/press rollers 37 and 38 (e.g., not shorter than 279 mm). If the length of the cut-off sheet is set to 279 mm, the roll sheet 4C may be cut when the leading edge 4C2 of the roll sheet 4C is located 279 mm ahead of the cutter mechanism 80 along the transportation direction. At the time point t8 when the leading edge 4C2 of the roll sheet 4C passes the registration switch 502, however, the transportation of the roll sheet 4C is stopped with the leading edge 4C2 abutting against the registration rollers 63 located at a position 50 mm apart from the cutter mechanism 80 in the transportation direction. Therefore, the roll sheet 4C may be transported by a distance of 229 mm (279 mm–50 mm) after the time point t8 when the leading edge 4C2 passes the registration switch 502. The division of the distance of 229 mm by a transportation rate of 80 mm/sec. gives a value of 2.86 seconds for the time period T3.

Figure 9:
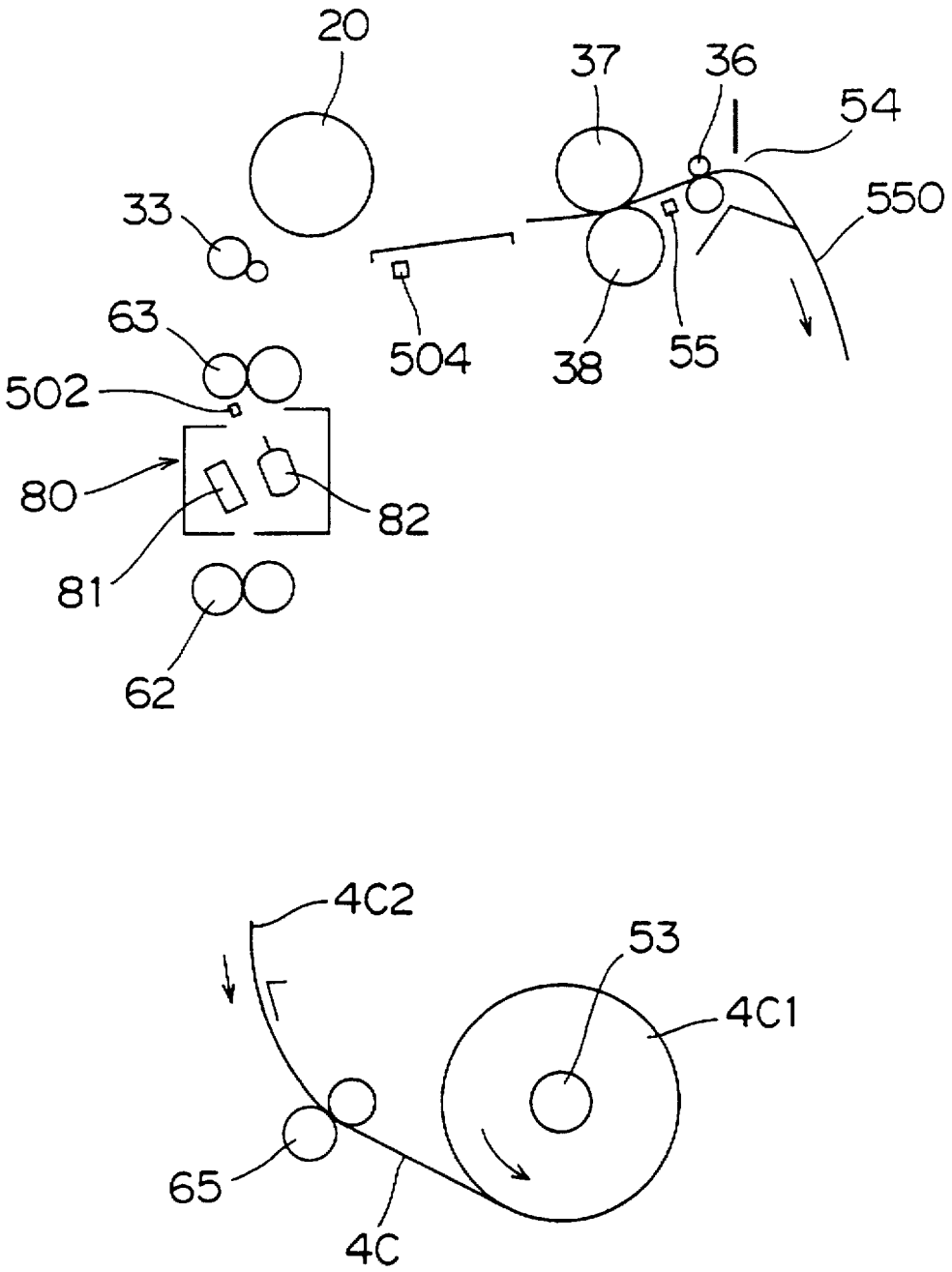
FIG. 9 is a schematic diagram of the transportation path illustrating a state where a cut-off portion of the roll sheet is discharged in the sheet cutting operation.
Figure 1:
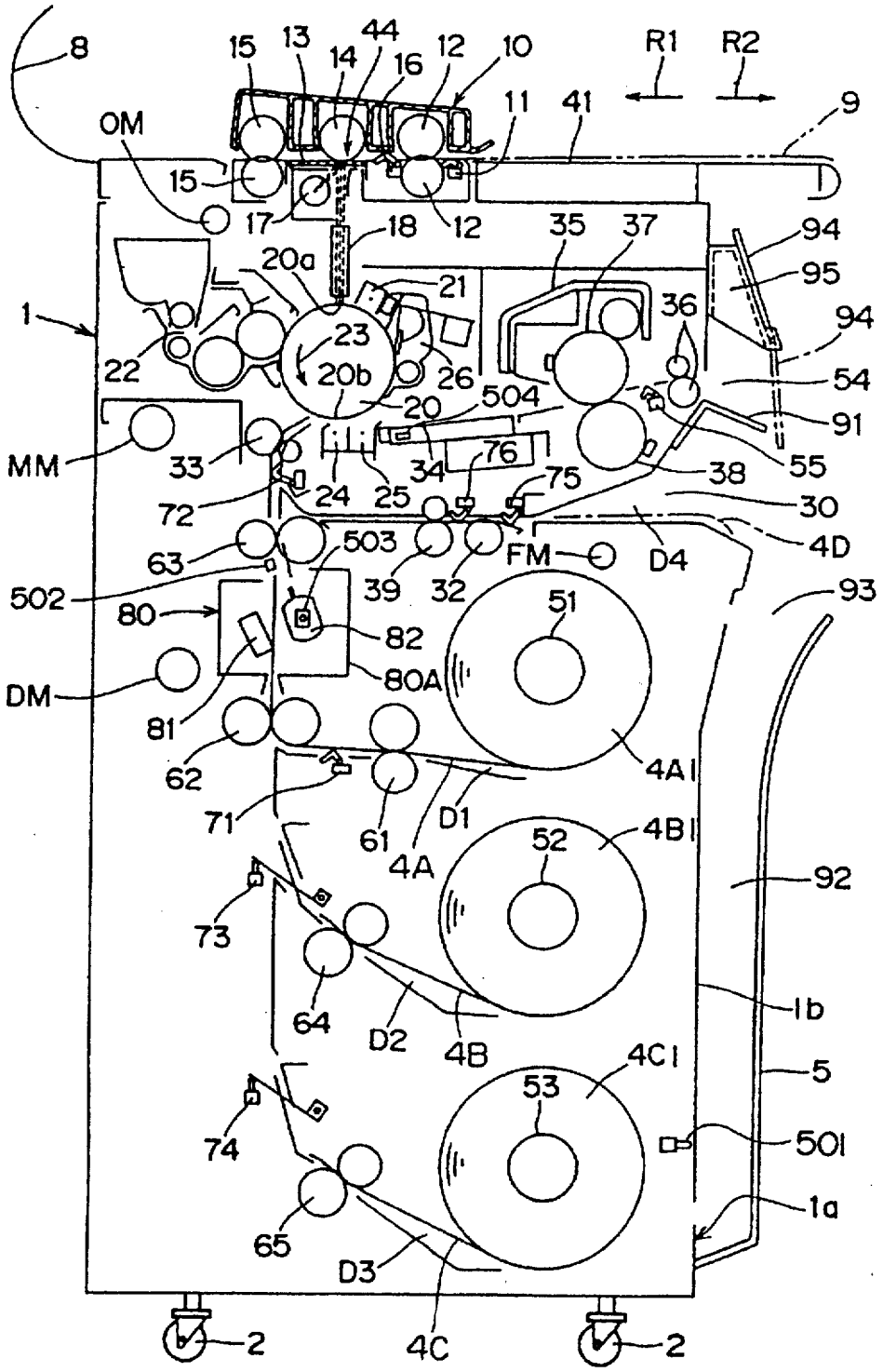
Figure 2:
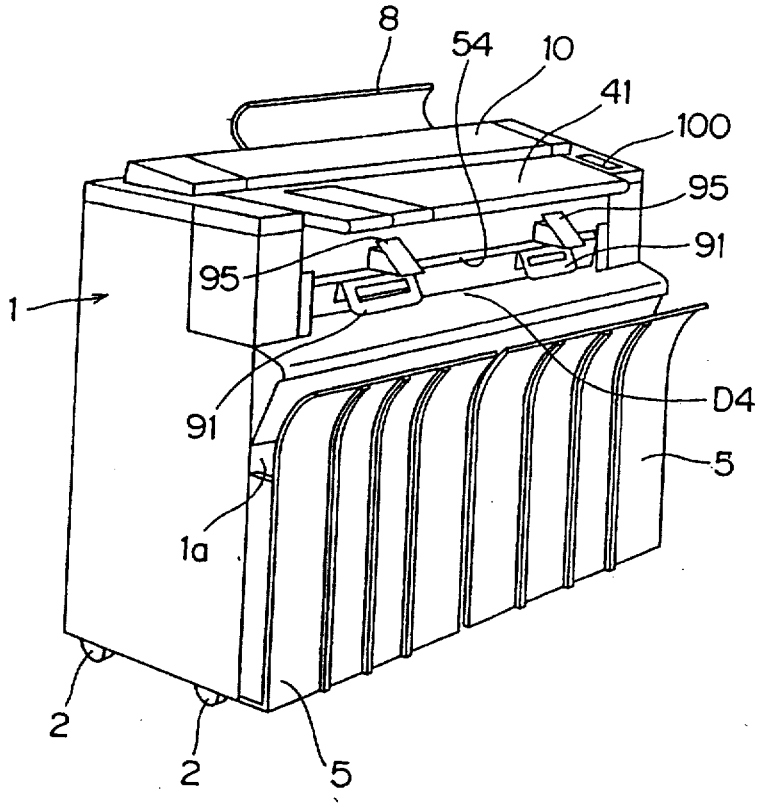
Figure 3:
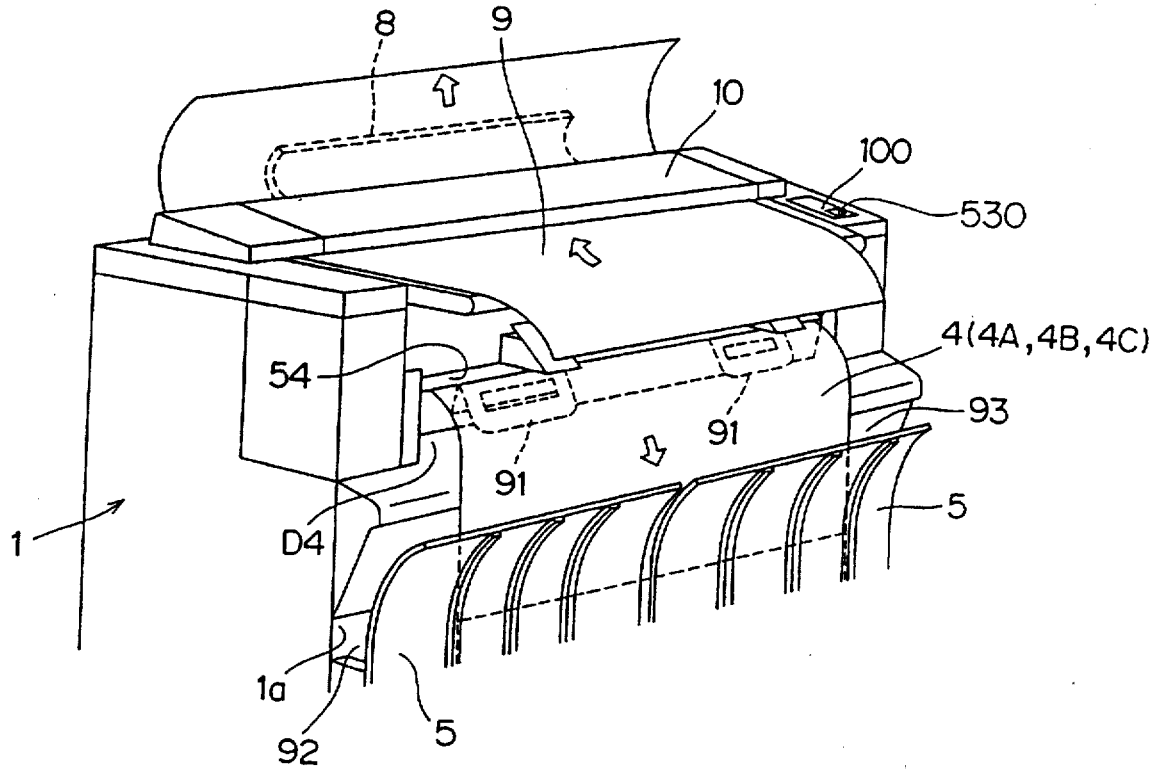

When the home position detecting switch 503 detects the rotary blade 82 returning to the home position at a time point t12 after completion of the sheet cutting, the sheet feeding clutch 521 and the transportation clutch 524 are switched off, and the sheet rewinding clutch 520 is switched on to rewind the roll sheet 4C as shown in FIG. 9. When the leading edge 4C2 of the roll sheet 4C is detected by the fourth leading-edge detection switch 74 at a time point t13, the sheet rewinding clutch 520 is switched off to stop the sheet rewinding. Thus, a new leading edge 4C2 of the roll sheet 4C is stopped at a preset position which is located at a predetermined distance upstream of the fourth leading-edge detection switch 74.

On the other hand, the cut-off sheet 550 is transported through the transportation path 34 by the driving of the main motor MM and the fixation motor FM, and discharged through the discharge port 54 into the pocket 92 in the same manner as in the ordinary copying operation as shown in FIG. 9. Since the cut-off sheet 550 is automatically discharged from the copying machine, the user does not have to manually remove the cut-off sheet which may otherwise remain in the copying machine in a conventional manner. With the conventional arrangement, a jam occurs due to the cut-off sheet remaining in the copying machine if the user does not remove the cut-off sheet before the next copying operation. However, this embodiment can avoid such an accident.

When the transportation switch 504 is switched off by the tail edge of the cut-off sheet 550 at a time point t14 during the process of discharging the cut-off sheet 550, the sheet feeding motor DM is stopped, and the registration clutch 523 is switched off to stop the registration rollers 63.

The main motor MM and the fixation motor FM are stopped at a time point t15 when the tail edge of the cut-off sheet 550 is detected by the discharge switch 55.

As for the roll sheets 4A and 4B in the upper and middle positions, the aforesaid advantages can be ensured by employing the same arrangement as described in this embodiment.

It should be noted that various changes and modifications can be made within the scope of the present invention as defined in the following claims.

What is claimed is:

1. An image forming apparatus comprising: a transportation path for guiding a roll sheet fed out of a roll body through an image forming section to discharge a cut-off portion of the roll sheet out of a main body of the image forming apparatus;

transportation means for transporting the roll sheet along the transportation path;

cutter means disposed in the transportation path for cutting the roll sheet;

control means for controlling operations of the transportation means and the cutter means; and signal outputting means for outputting a signal indicative of completion of replacement of the roll body;

wherein the control means, in response to the signal inputted from the signal outputting means, controls the operations of the transportation means and the cutter means so as to feed the roll sheet out of the roll body, then cut off a leading edge portion of the fed-out roll sheet having a predetermined length from the leading edge of the roll sheet and guide the cut-off portion along the transportation path to discharge the cut-off portion out of the main body.

2. An image forming apparatus as set forth in claim 1, wherein the transportation means include a plurality of downstream transportation means disposed downstream of the cutter means, and wherein the cut-off portion has a length equivalent to or greater than the greatest one of distances between respective adjacent pairs of downstream transportation means.

3. An image forming apparatus as set forth in claim 1, further comprising:

a door which is openable to expose at least one part of inside of the main body for replacement of the roll body;

wherein the signal outputting means outputs a signal indicative of opening and closing of the door.

4. An image forming apparatus as set forth in claim 3, wherein the signal outputting means serves as means for detecting the opening and closing of the door.

* * * * *

UNITED STATES PATENT AND TRADEMARK OFFICE

CERTIFICATE OF CORRECTION

PATENT NO. : 5,758,248
DATED : May 26, 1998
INVENTOR(S) : Katsuhiro Yoshiuchi, et al.

It is certified that error appears in the above-identified patent and that said Letters Patent is hereby corrected as shown below:

The sheets of drawings consisting of figures 1-9 should be deleted to appear as per attached figures 1-9. Figure 4 should be added with the attached figures.

Signed and Sealed this

Twenty-sixth Day of September, 2000

*Attest:*

Q. TODD DICKINSON

*Attesting Officer*

*Director of Patents and Trademarks*

500
CONTROL CIRCUIT
71,73,74
LEADING-EDGE DETECTION SW
502
REGISTRATION SW
503
HOME POSITION DETECTION SW
530
LEADING-EDGE CUTTING KEY
501
SAFETY SW
DM
FM
MM
520
SHEET REWINDING CLUTCH
521
SHEET FEEDING CLUTCH
524
TRANPORTATION CLUTCH
525
CUTTER CLUTCH
523
REGISTRATION CLUTCH
51,52,53
FEED REEL
62
TRANSPORTATION ROLLERS
82
ROTARY BLADE
63
REGISTRATION ROLLERS